United States Patent [19]

Richards

[11] Patent Number: 4,632,598

[45] Date of Patent: Dec. 30, 1986

[54] MOVABLE ROADWAY BARRIER

[76] Inventor: David B. Richards, 33465 Caliban Dr., Fremont, Calif. 94536

[21] Appl. No.: 755,950

[22] Filed: Jul. 15, 1985

[51] Int. Cl.[4] ..... E01F 13/00; E01F 15/00

[52] U.S. Cl. ..... 404/6; 404/9

[58] Field of Search ..... 404/6, 9, 12, 13, 73; 256/13.1

[56] References Cited

U.S. PATENT DOCUMENTS

| | | | |
|---|---|---|---|
| 2,931,279 | 5/1960 | Wiswell | 404/13 |
| 3,245,327 | 4/1966 | Wasley | 404/12 |
| 3,391,620 | 7/1968 | Mahoney | 404/6 |
| 3,958,840 | 5/1976 | Ferrari | 404/9 |
| 4,004,857 | 1/1977 | Eschen, Jr. | 404/6 |
| 4,017,200 | 4/1977 | Woods, Jr. | 404/6 |
| 4,474,503 | 10/1984 | Booth et al. | 404/9 X |
| 4,498,803 | 2/1985 | Quittner | 404/6 |
| 4,500,225 | 2/1985 | Quittner | 404/6 |

*Primary Examiner*—Stephen J. Novosad
*Assistant Examiner*—Michael A. Goodwin
*Attorney, Agent, or Firm*—Robert R. Tipton

[57] ABSTRACT

An elongated roadway barrier having an upright wall attached to a base support adapted to engage a roadway surface is provided with retractable wheels which are lowered simultaneously with the application of a lateral force to the barrier using a cable system attached to drive motors located proximate the side of the roadway or using a self-propelled drive mounted in the barrier.

6 Claims, 19 Drawing Figures

MOVABLE ROADWAY BARRIER

BACKGROUND OF THE PRIOR ART

This invention relates generally to roadway barriers and in particular to movable roadway barriers used for traffic lane control.

The roadway barriers of the prior art were provided with a number of different devices for making them movable.

In one case, a plurality of overhead trusses spanning the highway and spaced apart along its length were used from which the barrier was suspended on cables. A trolley on each of the trusses moved the suspended barrier from one lane to another to facilitate a change of lane.

Other movable barriers utilized a plurality of spaced apart, laterally disposed slots in the roadway to house an hydraulic apparatus to move the barrier laterally from one lane to the next.

Another barrier utilized a complex system of vertically disposed, abutting pillars imbedded in a slot along the length of the roadway at the lane marker position. One lane utilized short pillars whose top surface was flush with the top of the roadway pavement. The other lane utilized taller pillars mounted in a similar slot in the adjacent lane. To change the barrier from one lane to the next, an apparatus pulled by a truck was used which similtaneously lifted the short pillars out of one lane and the tall pillars out of the adjacent lane and serially interchanged the two sets of pillars in the two slots.

All of these barriers and the apparatus to move them were somewhat complex and expensive. In addition, their method of installation involved some extensive revisions to the roadway adding considerably to the installation cost of the barrier and requiring expensive repair to the roadway when the barrier was permanently removed.

SUMMARY OF THE INVENTION

A movable barrier of the present invention provides a much simpler and more economical solution by comprising a base support, adapted to engage a supporting surface, such as a roadway, which is combined with a generally upright wall member that is attached to the base support. The movable barrier further includes an apparatus for raising and lowering the barrier comprising a set of barrier support wheels, a lever arm, and means connected between one end of the lever arm and the set of barrier support wheels for moving said set of wheels in an upward and downward direction relative to the base support so that, when the lever arm is actuated in either direction from a central position, the set of wheels is moved in the downward direction.

The movable barrier of the present invention also includes a means for operating the lever arm and moving the barrier in a lateral direction comprising a trolley or like means for moving the lever arm in one direction to lower the wheels and raise the base support above the roadway surface to support the barrier on the support wheels and simultaneously apply a lateral force to the barrier sufficient to move barrier in a lateral direction across the roadway while being carried on the set of wheels. Finally, the barrier is provided with a means for moving the lever arm in a reverse direction to raise the wheels and lower the base support to again engage the surface of the roadway. The means for moving the barrier in the lateral direction can comprise, basically, right and left cable drive motors located proximate each side of the roadway with the central portion of the cable connected to the trolley or other means for moving the lever arm. Each end of the cable is connected to a respective take-up reel, or the like, connected to each of the cable drive motors.

Operation of one or the other cable drive motors will then move the means for activating the lever arm in one direction or the other and to provide the force necessary to move the barrier laterally across the roadway.

The means for laterally moving of the barrier can also comprise a cable in which each end of the cable is attached to an anchor proximate each side of the roadway and the cable drive motor is contained within the barrier, the cable being frictionally connected to a capstan operated by the cable drive motor whereby actuation of the drive motor results in the operation of the trolley or other apparatus that causes rotation of the lever arm and simultaneously applies a lateral force to the barrier to move the barrier across the roadway.

The device for moving the lever arm in one direction to raise the base support from the supporting surface and simultaneously apply a lateral force to the barrier can also comprise, basically, a drive motor adapted to drive a trolley connected to the lever arm, the trolley being provided with traction wheels that perform the same function as the cable whereby the trolley traction wheels frictionally engage the supporting surface and simultaneously apply a force to the lever arm and barrier to raise the barrier and move it in a lateral direction across the roadway.

It is, therefore, an object of the present invention to provide a movable barrier for use in changing lanes on a roadway.

It is a further object of the present invention to provide a barrier having a driving means that raises the barrier on wheels and moves the barrier in a lateral direction and then lowers the barrier onto the supporting surface.

It is another object of the present invention to provide a movable barrier in which cables driven by drive apparatus along the edge of the roadway first raises the barrier on wheels or rollers and then moves the barrier in a lateral direction across the road.

It is again a further object of the present invention to provide a movable barrier for a roadway that is self-propelled using a driving means located in the barrier itself.

It is still a further object of the present invention to provide a movable barrier in which the sectional barriers are interlocked with each other so that all may simultaneously be raised, lowered and moved as single unit.

It is yet another object of the present invention to provide a means for connecting the barriers together whereby failure of one lifting mechanism in the end of one barrier section will not prevent the barrier from being lifted using the lifting mechanism in the adjacent barrier.

These and other object of the present invention will become manifest upon careful study of the following detailed description when taken together with the drawings.

DESCRIPTION OF THE PREFERRED EMBODIMENT

Figure 1:
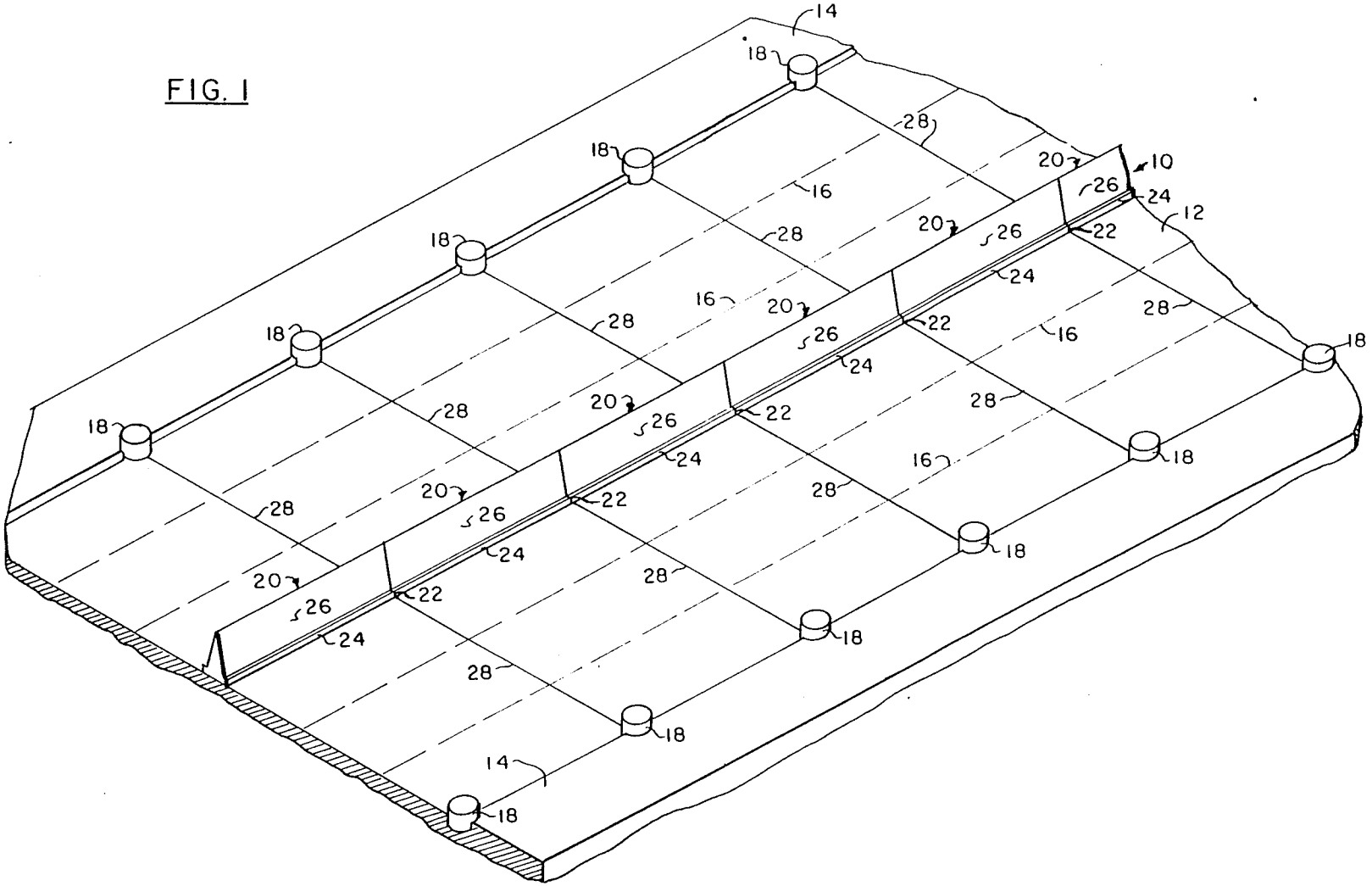
FIG. 1 is an isometric view of a typical roadway showing the barrier of the present invention in place and the means exterior of the barrier by which it is moved laterally across the roadway.

With reference to FIG. 1, there is illustrated an isometric view of the barrier 10 of the present invention shown placed on the center dividing line of roadway or supporting surface 12.

Roadway 12 comprises a pair of sidewalks or parking strips 14 defining its outer edge.

Lane markers 16 are shown dividing roadway 12 into three lanes in each direction.

Barrier 10 comprises a plurality of individual barrier sections 20 attached to each other at their ends by a connector member 22. Connector member 22 is shown in greater detail in FIGS. 14, 15 and 16A through 16D.

Individual barrier sections 20, as shown in FIG. 1, comprise, basically, a base support 24, adapted to rest on the surface of roadway 12, which base support 24 is attached to an upward projecting barrier wall portion 26.

A plurality of transverse grooves or channels 28 are located across roadway 12 which are adapted to contain a pulling cable.

A cable drive motor housing 18, having access to groove or channel 28, is located proximate sidewalk 14 on each side of roadway 12.

As will be described in detail below, barrier 10 is caused to move laterally from the center lane marker or one lane marker 16 to the next adjacent lane marker by apparatus both within and without barrier 10. This apparatus first causes the individual barrier sections to be raised on wheels and simultaneously moved laterally, while being carried on the wheels, to the next lane marker where the barrier is then lowered so that base support 24 again frictionally engages or rests on the surface of roadway 12. The weight of the barrier is such that the frictional resistance of base support 24 against the surface of roadway 12 combined with the general rigidity of end connector 22 will maintain barrier 10 in a fixed position in the event a vehicle collides with the barrier.

The apparatus for lifting and moving the barrier laterally is illustrated in FIGS. 2, 3, 4, 5 and 6.

Figure 2:
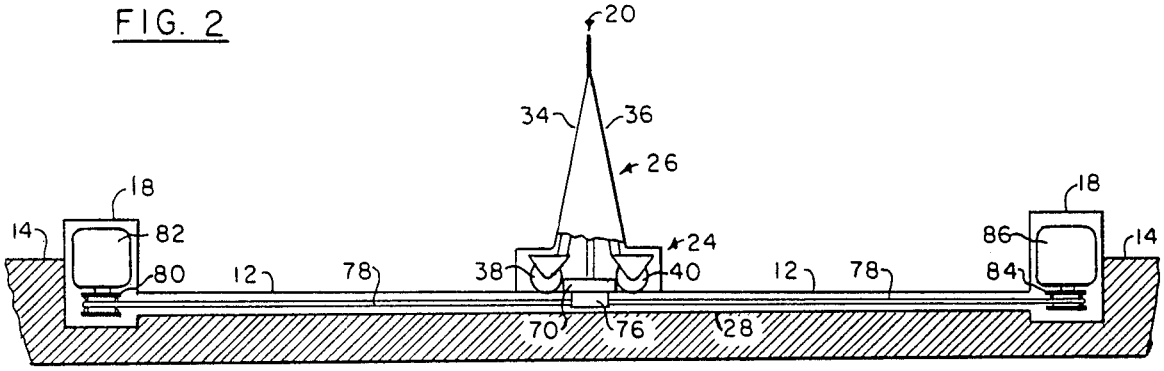
FIG. 2 is a cross-sectional, elevational view of the barrier and roadway of the present invention taken perpendicular to the longitudinal axis of the barrier.

FIG. 2 is a cross-sectional, elevational view of a movable barrier section 20 taken proximate one end of a barrier section at a groove or channel 28 showing the barrier resting with its base support 24 engaging the surface of roadway 12.

Figure 3:
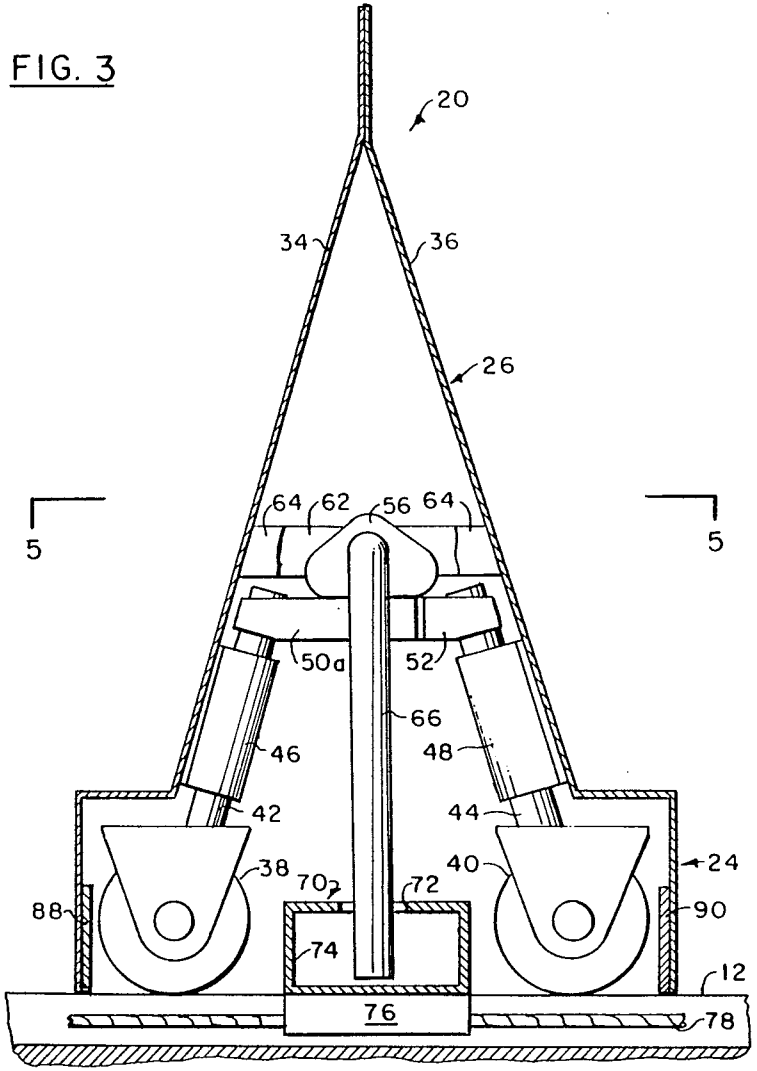
FIG. 3 is a cross-sectional, elevational view of the barrier of the present invention showing the details of the mechanism for raising and lowering the barrier.

FIG. 3 is a partial cut-away, longitudinal cross section through one end of barrier section 20.

Figure 4:
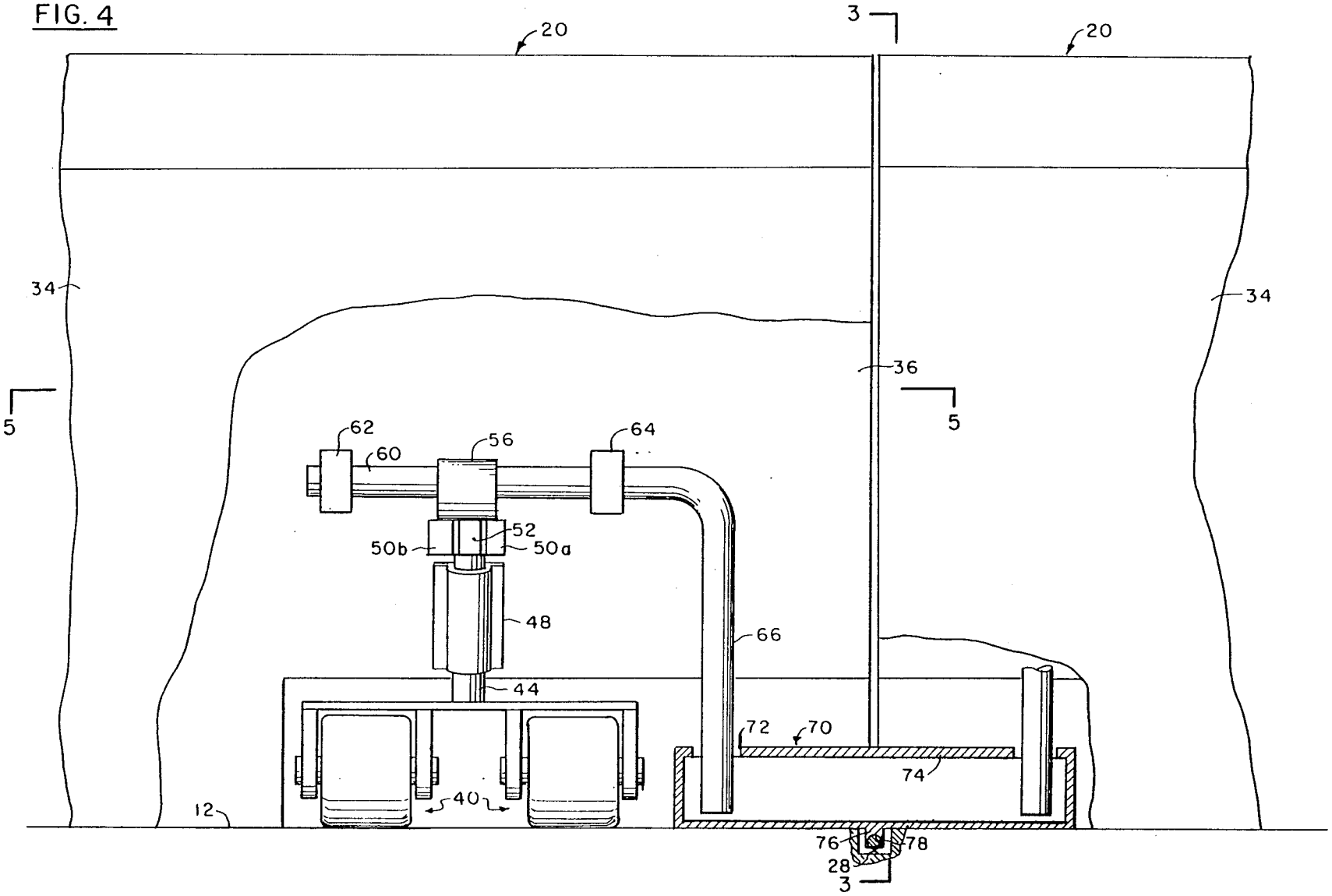
FIG. 4 is a side elevational, partial cut-away view of the lifting and moving apparatus of the barrier shown in FIG. 3.

FIG. 4 is a partial cut-away, sectional side view through one end of barrier section 20.

Figure 5:
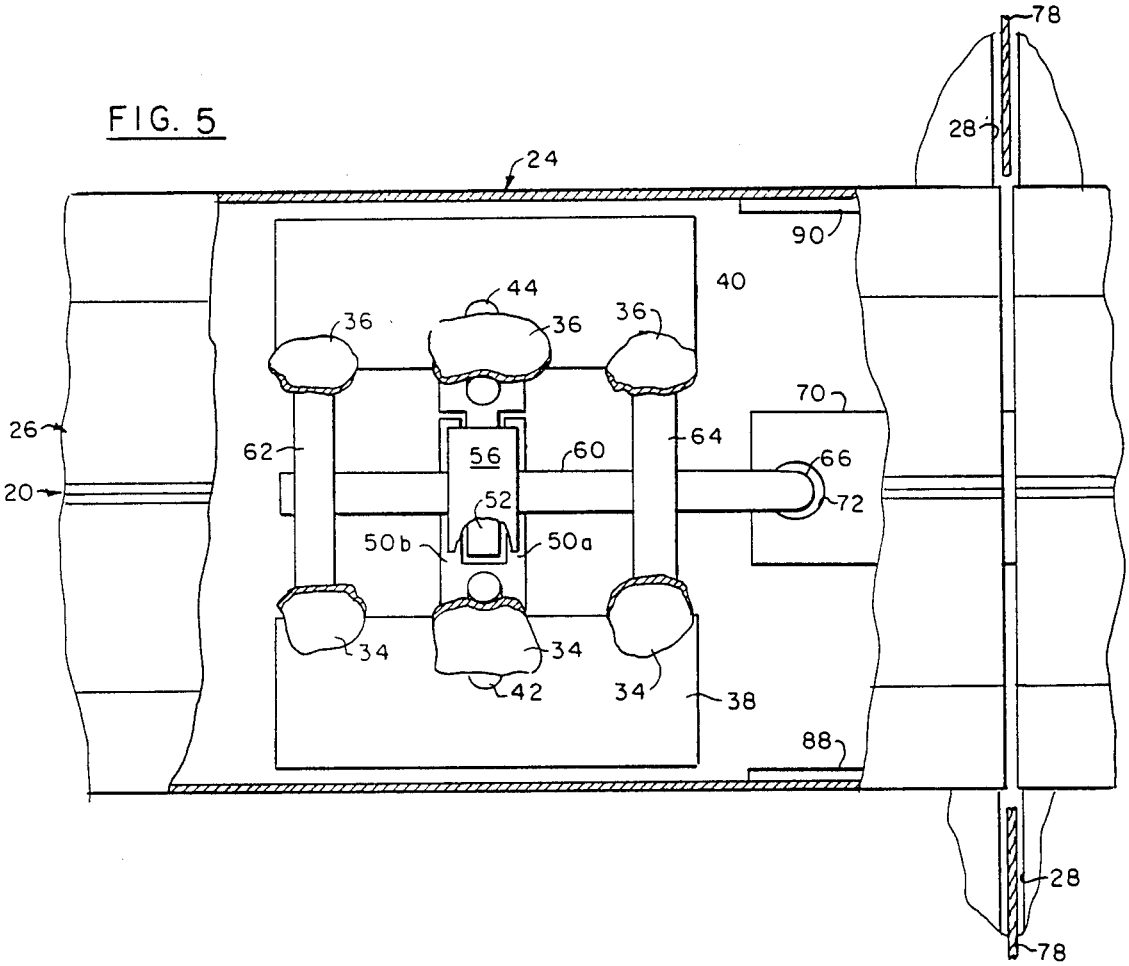
FIG. 5 is a top, partial cut-away plan view of the barrier of the present invention showing the apparatus for lifting and laterally moving the barrier shown in FIG. 3.

FIG. 5 is a partial cut-away, sectional plan view through one end of barrier section 20 taken at line 5—5 of FIG. 3.

With reference to FIG. 2, barrier section 20 comprises, basically, a base support 24 adapted to frictionally engage the surface or roadway 12 and having a generally upright wall member 26 attached thereto. Upright wall member 26 comprises left and right side support plates 34 and 36, respectively.

With reference to FIGS. 3, 4, 5 and 6, the apparatus for lifting and moving barrier section 20 laterally comprises, basically, a set of left and right barrier support wheels 38 and 40, respectively, attached to left and right support legs 42 and 44.

Left and right support legs 42 and 44 are contained in and guided by left and right guide cylinders 46 and 48, respectively. Left guide cylinder 46 is attached to left side plate 34 of upright wall member 26 while right guide cylinder 48 is attached to right side plate 36 of upright wall member 26.

The upper end of left support leg 46 is attached to left cam follower bar 50 (50*a*, 50*b*). Left cam follower bar 50 (50*a*, 50*b*) (see FIGS. 4 and 5) comprises two spaced apart bars 50*a* and 50*b* adapted to engage cam 56 both of which are attached to left support leg 38.

The upper end of right support leg 44 is attached to right cam follower 52 which comprises a single cam follower bar 52 (see FIGS. 4 and 5) also adapted to independently engage cam 56. Neither of the two cam follower bars 50 or 52 are connected to each other but act independently of each other under the influence of cam 56.

The configuration of cam followers 50 and 52 is used in order to permit support legs 42 and 44 to move at an angle to each other and still be driven by a common cam 56.

Cam 56 is connected to a cam shaft 60 which is journaled to cam shaft bearings 62 and 64. Cam shaft bearing 62 and 64 are each attached to left and right side plates 34 and 36 of upright wall member 26.

Cam shaft 60 is attached proximate one end of lever arm 66. Lever arm 66 is adapted to depend downwardly from cam shaft 60 where the other end of lever arm 66 engages hole 72 in one end of trolley 70.

Figure 6:
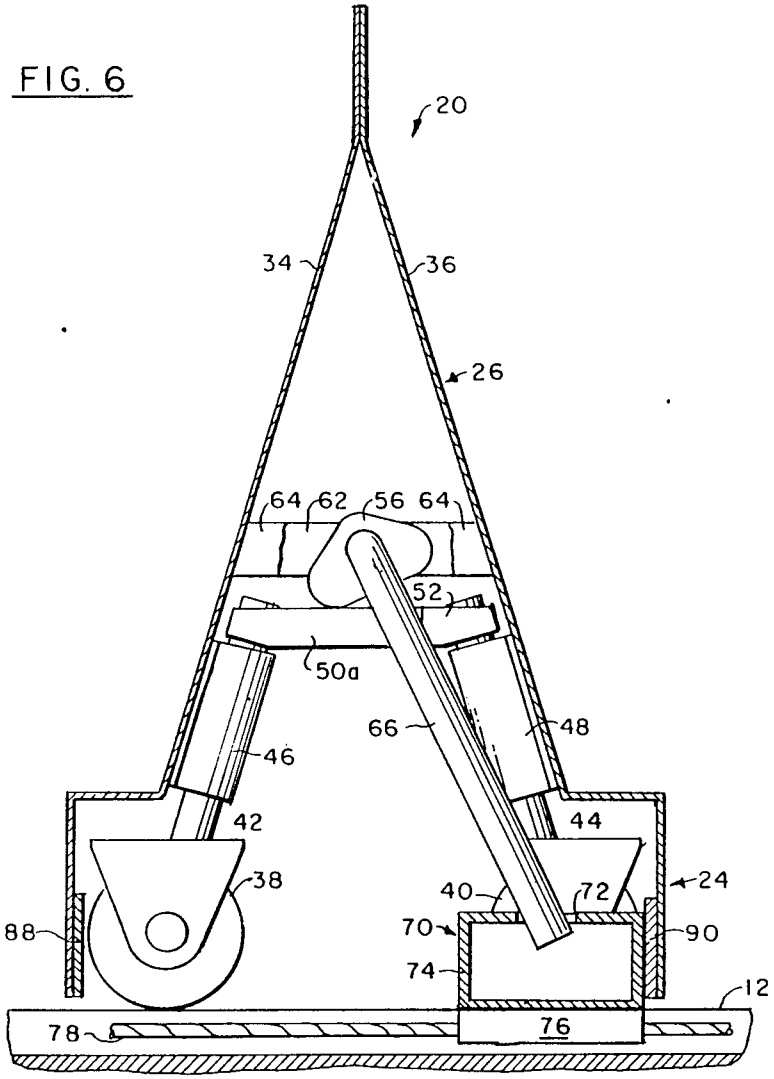
FIG. 6 is cross-sectional, elevational view of the barrier of FIG. 3 showing the barrier in the raised position.

As can be seen in both FIG. 3 and FIG. 6 that, as the bottom end of lever arm 66 is moved either to the left (rotating cam 56 clockwise) or to the right (rotating cam 56 counterclockwise), cam 56 is caused to bear downwardly against cam follower bars 50 and 52.

As the means by which lever arm 66 is caused to rotate and also the means for applying a lateral force to barrier 20, trolley 70 comprises a rectangular housing 74 having a hole 72 at each end adapted to receive the bottom end of lever arm 66. Trolley 70 is further provided with a cable clamp 76 attached to the underside housing 74.

Cable clamp 76 is adapted to clamp on to cable 78 and be slidable within groove or channel 28 in roadway 12 while attached to drive cable 78.

The apparatus for actuating or moving trolley 70 using cable 78 is illustrated in FIG. 2. In FIG. 2, cable 78 is shown disposed in groove or channel 28 with its left end connected to left take-up reel 80 of left cable drive motor 82. The right end of cable 78 is shown connected to right take-up reel 84 of right cable drive motor 86.

Thus, for this configuration, when right cable drive motor 86 is actuated, cable 78 is pulled to the right toward right take-up reel 84 and away from, that is, unwound from left take-up reel 80 of left cable drive motor 82 which is not energized.

As can be seen in FIG. 6, as cable 78 is pulled to the right, trolley 70 attached thereto is caused to move to the right until the right side of trolley 70 engages and bears against right bearing pressure plate 90 attached to the inside of the right side of base support 24.

As trolley 70 continues to be pulled to the right, the bottom end of lever arm 66, which is engaged in hole 72 of trolley 70, is also pulled to its maximum right position as shown in FIG. 6. As it is pulled, cam shaft 60 is caused to rotate counterclockwise causing cam 56 to assume the position shown in FIG. 6 in which position it bears down on cam follower bars 50 (50*a*, 50*b*) and 52 forcing them to move down relative to base support 24 thus causing wheels 36 and 38 to bear on the surface of roadway 12.

Since cam shaft 60 is journaled to bearings 64 which are attached to barrier side plates 34 and 36 of upright wall member 26, the continued movement of lever arm 66 to the right will cause barrier section 20 to be raised above the surface of roadway 12 and become supported on wheel assemblies 38 and 40.

In addition, as trolley 70 bears against right bearing pressure plate 90, this lateral force will cause barrier section 20 to move laterally to the right because of the reduced friction when the barrier is supported on wheels 38 and 40.

After barrier section 20 reaches an adjacent lane marker 18, right cable drive motor 86 is deactivated and left cable drive motor 82 is activated to place cable 78 in tension and pull trolley 70 back to a central position, as shown in FIG. 3, whereby, because of the shape of cam 56, barrier 20 is lowered and wheels 38 and 40 are raised to again cause base support 24 to frictionally engage the surface of roadway 12.

To illustrate other embodiments that can be used to lift and laterally move barrier section 20, attention is called to FIGS. 7, 8, 9, and 10.

Although barrier sections 20 can be moved by drive motors 82 and 86 located along the side of the roadway, it is also possible to move barrier sections 20 using reversible drive motors housed within the barrier.

Figure 7:
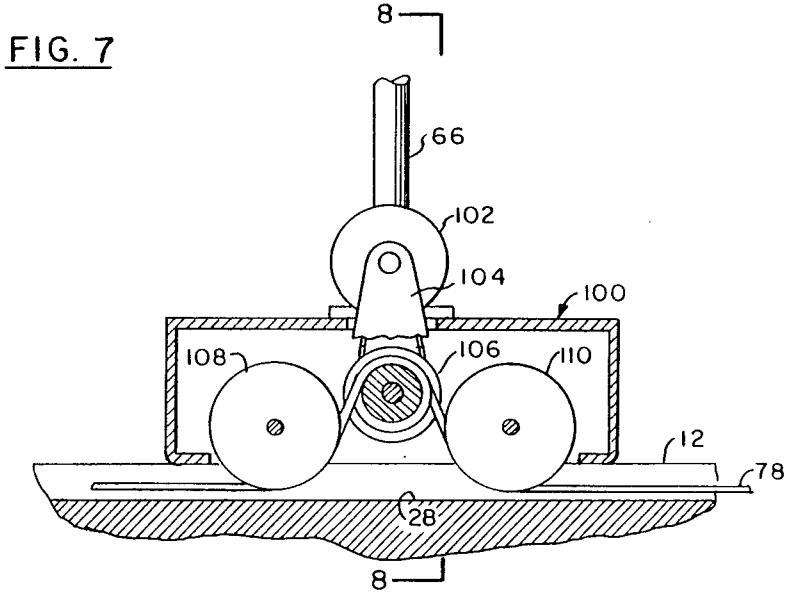
FIG. 7 is a cross-sectional, elevational view taken perpendicular to the longitudinal axis of the barrier of the present invention showing a further embodiment of the cable drive mechanism used to move the barrier laterally across the roadway in which the drive unit is contained within the barrier.

With reference to FIG. 7 there is illustrated a trolley 100, similar to trolley 70, in which a reversible drive motor 102 is mounted on the top of trolley 100 and connected through a drive belt or gear reduction 104 to a capstan 106.

Capstan 104 is adapted to frictionally engage cable 78 through several turns around the capstan. Cable 78 is guided to and from capstan 106 by left and right idler pulleys and 108 and 110, respectively.

Although trolley 100 is shown sliding along the surface of roadway 12, it can also be equipped with friction reducing wheels (not shown) common in the art.

Figure 10:
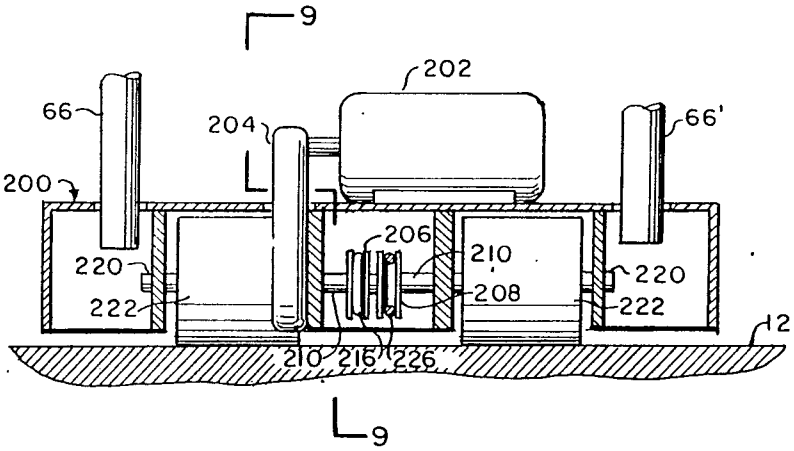
FIG. 10 is a side elevational view of the apparatus of FIG. 9.
Figure 9:
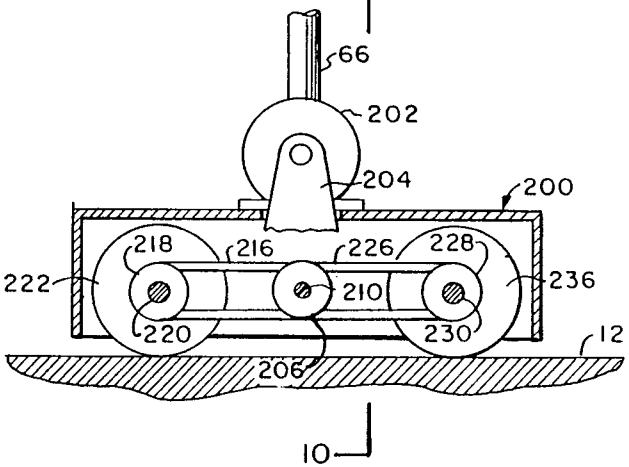
FIG. 9 is a cross-sectional, elevational view taken perpendicular to the longitudinal axis of the barrier in which a wheel drive apparatus contained within the barrier is used in lieu of a cable for simultaneously operating the lever arm and moving the barrier laterally across the roadway.

With reference to FIGS. 9 and 10, there is illustrated a further embodiment of an apparatus for causing lateral movement of barrier section 20 utilizing a trolley device 200 whose wheels 222 and 236 are adapted to frictionally engage the surface of roadway 12.

Trolley 200 comprises a reversible drive motor 202 mounted on the top of trolley 200 and connected through a drive belt or gear reduction 204 to a pair of belt drive pulleys or sprocket wheels 206 and 208, respectively, attached to shaft 210.

A belt drive or sprocket chain 216 is connected between belt drive pulley or sprocket wheel 206 attached to shaft 210 and belt drive pulley sprocket wheel 218 attached to wheel shaft 220. Drive wheels 222 are also attached to wheel shaft 220.

In a like manner, a drive belt or sprocket chain 226 is connected between belt drive pulley or sprocket wheel 208 attached to shaft 210 and belt drive pulley or sprocket wheel 228 attached to wheel shaft 230. Drive wheels 232 are also attached to wheel shaft 230.

Figure 8:
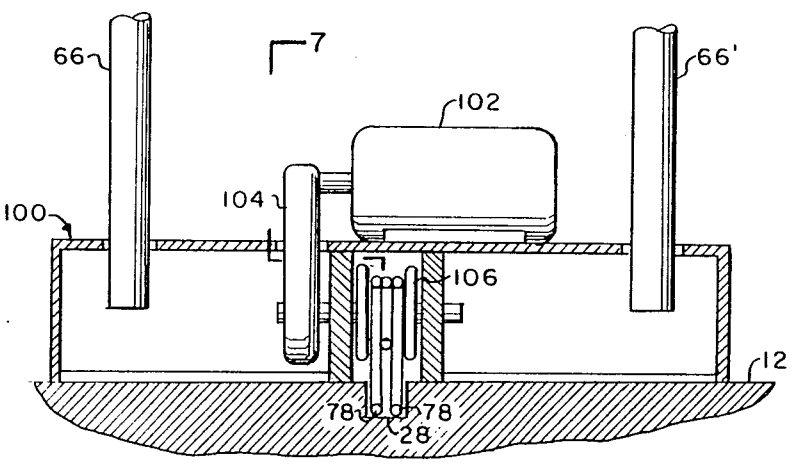
FIG. 8 is side elevational view of the drive mechanism of FIG. 7.

Thus, when trolley drive motor 202 is activated, drive wheels 222 and 236 are cause to rotate and move trolley 200 in a direction lateral to the barrier in a manner similar to the apparatus of FIGS. 7 and 8 in which a cable was attached to the trolley. Lever arm 66 is thus cause to rotate and raise barrier 20 on wheels 38 and 40 and simultaneously engage bearing plate 98 or 90 to move barrier 20 in a lateral direction.

Figure 11:
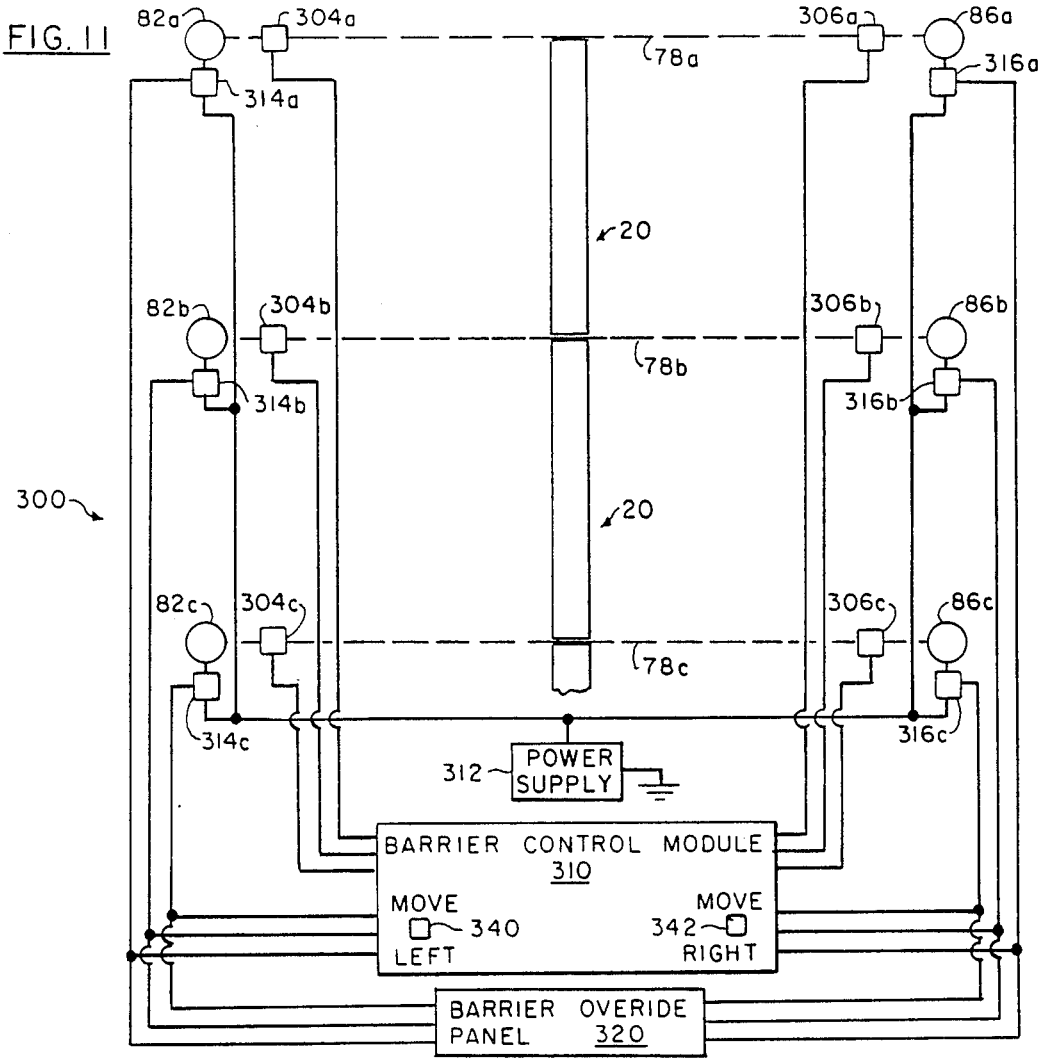
FIG. 11 is a schematic combined apparatus and block diagram showing the method for controlling the operation of the barrier of the present invention where the drive mechanism is located outside the barrier.
Figure 12:
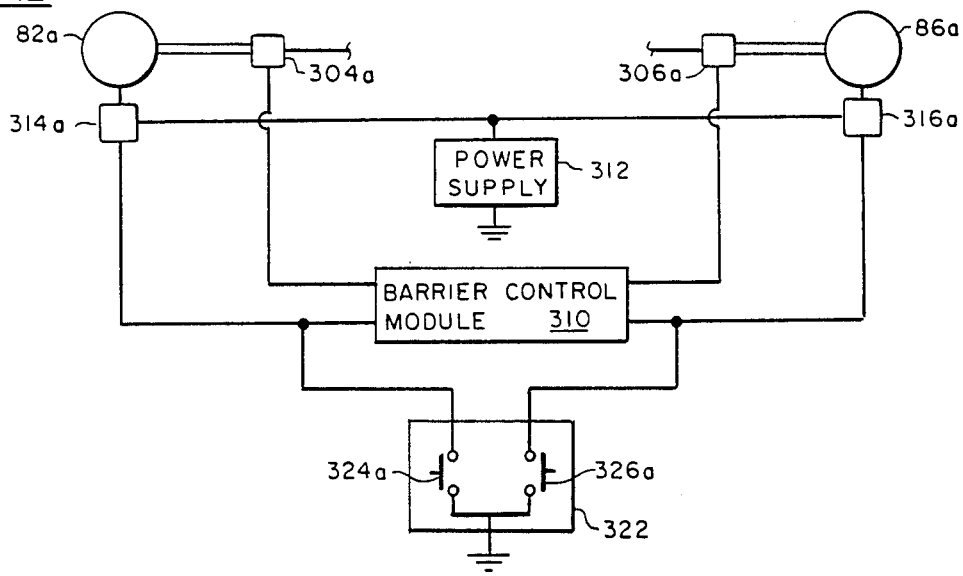
FIG. 12 is a schematic combined apparatus and block diagram showing the method of by-passing the barrier control module in order to control individual barrier sections.
Figure 13:
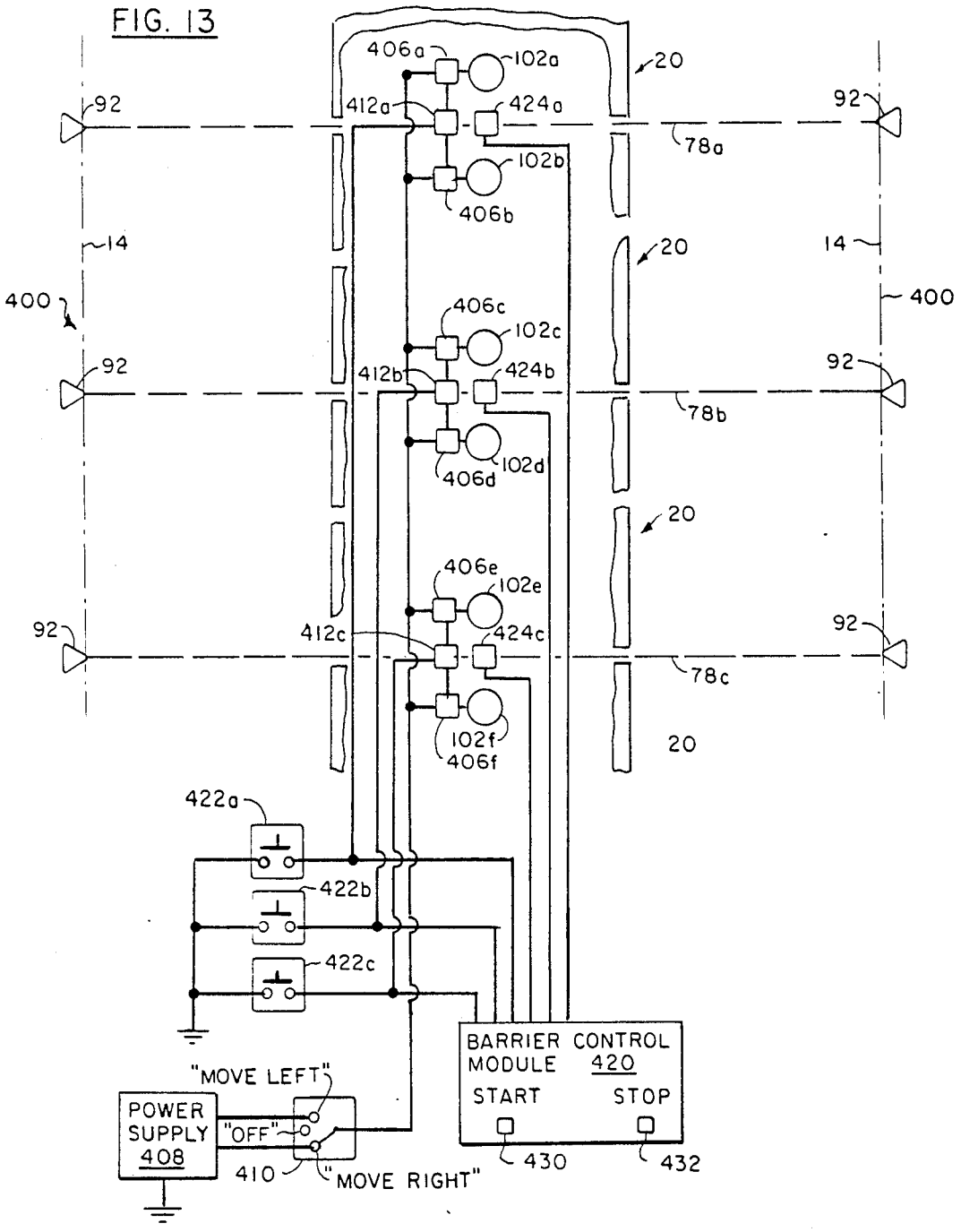
FIG. 13 is a schematic combined apparatus and block diagram showing the method for controlling the operation of the barrier of the present invention where the drive mechanism is contained within the barrier.

FIGS. 11, 12 and 13 are schematic apparatus and circuit diagrams of control systems 300 (FIGS. 11 and 12) and 400 FIG. 13) showing how movement of the barrier is controlled.

FIG. 11 is a schematic apparatus and block circuit diagram of control system 300 for the barrier configuration shown in FIG. 1 where the cable drive motors 82 and 86 are located along the side of roadway 12.

FIG. 13 is a schematic apparatus and block circuit diagram of control system 400 for the barrier configuration where the drive motor is located inside the end of the barrier and the cables are anchored along the side of roadway 12. This diagram would also be applicable where the barrier uses the wheel traction vehicle shown in FIGS. 9 and 10.

In cases where the drive motors are located inside the barrier, sensors (common in the art) can be placed either in or on the pavement to detect the barrier as it passes across the pavement or sensors can be placed within the barrier to detect markers placed on the pavement that can be detected to determine barrier position and orientation. The sensors can also a comprise a microswitch to detect rotations of a measuring wheel connected to the barrier and frictionally engaging the pavement.

With reference to FIG. 11, the control system 300 comprises, basically, a barrier control module 310 utilizing a computer and separate controls (not shown) for each individual drive motor 82 (82*a*, 82*b*, 82*c*) and 86 (86*a*, 86*b*, 86*c*).

The computer and controls are those well known in the art which includes a memory to store data, a processor to compare data and actuating relays connected thereto and actuated thereby.

As in with all computers, is is controllable through the use of a program written in an appropriate computer readable language.

The details of the computer and its program to perform the functions described herein as not shown since such details of computer hardware and software are now well known in the art.

Each individual drive motor 82 and 86 is provided with a corresponding barrier position sensor 304 (304*a*, 304*b*, 304*c*) for drive motor 82 and barrier position sensor 306 (306*a*, 306*b*, 306*c*) for drive motor 86.

All barrier position sensors 304 and 306 are connected to barrier control module 310.

Barrier position sensors 304 and 306 can be adapted to measure position in a number of ways. The sensor can utilize a microswitch or other device to count links of a chain used as a drive cable or markers attached to drive cables 78 (78*a*, 78*b*, 78*c*) or count the revolutions of the take-up reels 80 (80*a*, 80*b*, 80*c*) and 84 (84*a*, 84*b*, 84*c*) attached to the drive motor shaft.

The sensor could also comprise a counter wheel frictionally engaging the cable and microswitch combination to measure the distance the cable has travelled based on revolutions of the counter wheel. All of these methods and devices are well known and common in the art.

Cable drive motors 82 and 86 are powered by power supply 312 through motor control relays 314 (314*a*, 314*b*, 314*c*) and 316 (316*a*, 316*b*, 316*c*), respectively. Motor control relays 314 and 316 are also electrically connected to barrier control module 310 as well as to barrier override panel 320.

Barrier override panel 320 is used to provide individual control of each barrier section 20 in order to override the automated control system of barrier control module 310 in the event one or more barrier sections 20 are incorrectly positioned.

The circuit for typical individual override control of a barrier section 20 to by-pass control by barrier control module 310 is shown in FIG. 12.

Barrier override control panel 320 comprises a pair of individual barrier override switches or push buttons for each cable drive motor 82 and 86. The circuit shown in FIG. 12 illustrates a typical override control 322 for one barrier connection or junction and comprises left override switch or push button 324*a* and a right override switch or push button 326*a*.

Left override switch 324*a* is shown connected to motor control relay 314*a* while right barrier override switch 326*a* is shown connected to right drive motor control relay 316*a*.

Both left and right motor control relays 314*a* and 316*a* are shown connected on their power input sides to power supply 312. Thus, upon activation of either left push button 324*a* or right push button 326*a*, either cable driven motor 82*a* or 86*a* will be actuated.

It can be seen that this override by-passes the information received from barrier position sensors 304 or 306 and allows separate control of individual barrier sections.

OPERATION

To operate the barrier control system 300 as shown in FIG. 11, an operator can initiate the process by pushing either move-left control 340 or move-right control 342 on barrier control module 310. In the event the operator wishes to move the barrier to the right, he would activate move-right control 342 which would then set in operation the procedure for raising and moving barrier 10, as previously described.

Upon activation of move-right control 342, control relays 316 (316*a*, 316*b*, 316*c*) are activated to connect power from power supply 312 to cable drive motors 86 (86*a*, 86*b*, 86*c*). When cable drive motors 86 are activated, the corresponding take-up reels 84 (84*a*, 84*b*, 84*c*) for each drive motor will rotate to take up cables 78 (78*a*, 78*b*, 78*c*) causing trolley 70 (FIGS. 3, 4, 5 and 6) to move to the right. As trolley 70 moves to the right, lever arm 66 will also be caused to move to the right in a counterclockwise direction as shown in FIG. 6.

As cable reels 84 (84*a*, 84*b*, 84*c*) continue to take up cable 78 (78*a*, 78*b*, 78*c*), barrier section 20 will continue to move to the right. Concurrently with the take-up of cable 78 (78*a*, 78*b*, 78*c*) on reels 84 (84*a*, 84*b*, 84*c*), barrier motion sensors 306 (306*a*, 306*b*, 306*c*) will be measuring, either by the number of rotations of take-up reels 84 (84*a*, 84*b*, 84*c*) or by a separate sensor connected to the cable, the amount movement or distance barrier section 20 has travelled.

When the side of housing 74 of trolley 70 engages bumper plate 90 attached to the inside of base support 24, the additional force caused by the pull of cable 78 (78*a*, 78*b*, 78*c*) driven by cable drive motors 86 will now cause barrier section 20 to move to the right since it is now supported on support wheels 38 and 40.

As lever arm 66 moves to the right in a counterclockwise direction, cam 56 is caused to bear, as previously described, against cam follower bars 50 (50*a*, 50*b*) and 52 thus forcing wheels 38 and 40 in a downward direction and raising barrier section 20 to lift base support 24 above the surface of roadway 12.

This data signal for each barrier section is transmitted to barrier control module 310 in which the data is stored and compared with other data concerning lane width.

Barrier control module 310, therefore, continuously compares the readings from sensors 306 (306*a*, 306*b*, 306*c*) and compares it with the stored data as to the lane width. When the data from sensors 306 (306*a*, 306*b*, 306*c*) is matched with the data concerning lane width in barrier control module 310, barrier control module 310 then sends a signal to the corresponding motor actuating relay 316 (316*a*, 316*b*, 316*c*) to deenergize, as required, cable drive motors 86 (86*a*, 86*b*, 86*c*).

When drive motors 86 (86*a*, 86*b*, 86*c*) are deenergized or deactivated, barrier control module 310 then activates left cable drive motors 82 (82*a*, 82*b*, 82*c*) to pull cable 78 (78*a*, 78*b*, 78*c*) in the opposite direction and, at the same time, received distance measuring information from sensors 304 (304*a*, 304*b*, 304*c*). This will cause trolley 70 to be moved in the opposite direction to the left.

When trolley 70 reaches the central or neutral position shown in FIG. 3, at which position the signals from sensors 304 (304*a*, 304*b*, 304*c*) will match the data stored in barrier control module 310, barrier control module 310 deenergizes or deactivates motor control relay 314 (314*a*, 314*b*, 314*c*) to stop cable drive motors 82 (82*a*, 82*b*, 82*c*).

Thus barrier sections 20 are now lowered so that base support 24 again frictionally engages the surface of roadway 12.

The barrier 10 of the present invention can operate in two modes. The barrier can be moved as a single unit laterally across the roadway as described above or barrier sections 20 can be moved sequentially to form a gradually merging lane beginning at one end of barrier 10 and progressing to the other end of barrier 10.

To move the barrier to form a progressively merging lane, the computer is programmed, or the barrier operator actuates cable drive motors 82 (82*a*, 82*b*, 82*c*, etc) or 86 (86*a*, 86*b*, 86*c*, etc) sequentially.

For example, to move barrier 10 to the right, cable drive motor 86*a* is activated by energizing motor control relay 316*a* to move the end of the barrier to the right. After the end of the barrier moves an increment of, say, 6 inches, cable drive motor 86*b* is activated by energizing motor control relay 316*b* to begin moving that portion of barrier 10 to the right. After cable drive motor 86*b* has moved barrier 10 to the right, say, 6 inches cable drive motor 86*c* is activated by energizing motor control relay 316*c* and so on for the length of the barrier until it has completed its lateral move to the next lane were cable drive motors 86 (86*a*, 86*b*, 86*c*, etc.) are sequentially deactivated and cable drive motors 82 (82*a*, 82*b*, 82*c*, etc.) are activated to move trolley 70 to the central position and lower the barrier to the roadway surface.

Also, it must be pointed out that a motor overload sensor (not shown), common in the art, can be connected to each motor to detect any overload caused by an obstruction on the roadway. This overload sensor can be used to alert the operator as to a damaged barrier section or obstruction, such as a stalled vehicle, on the roadway.

With reference to FIG. 13, there is illustrated control system 400 for use where the drive motors for the barrier are located inside each barrier section 20.

In the configuration shown in FIG. 13, cables 78 (78*a*, 78*b*, 78*c*) are attached to anchors 92 located on each side of the roadway.

Typically, within each end of barrier section 20 is a drive motor 102 (102*a*, 102*b*, 102*c*, 102*d*, 102*e* and 102*f*).

Each of the drive motors is actuated through a motor starter relay 406 (406*a*, 406*b*, 406*c*, 406*d*, 406*e*, 406*f*) corresponding to the letter identified for the drive motor.

Each of the motor starter relays 406 (406*a*, 406*b*, 406*c*, 406*d*, 406*e*, 406*f*) are electrically connected to a power supply 408 through a phase reversal switch 410.

Motor starter relays 406 (406*a*, 406*b*, 406*c*, 406*d*, 406*e*, 406*f*) are connected to and actuated by a corresponding motor starter actuating relay 412*a* for motor starters 406*a* and 406*b*, motor starter actuating relay 412*b* for motor starters 406*c* and 406*d*, and motor starter actuating relay 412*b* for motor starters 406*e* and 406*f*.

Each motor starter actuating relay 402 (402*a*, 402*b*, 402*c*) is, in turn, electrically connected individually to barrier control module 420 and as well as to by-pass controls or pushbuttons 422*a*, 422*b* and 422*c* corresponding to the same lettered actuating relay.

By-pass controls 422*a*, 422*b* and 422*c* comprise either a pushbutton as shown or an actuating switch.

Barrier motion sensors 424*a*, 424*b* and 424*c* are used to measure the distance barrier section 20 has moved. This can comprise a counter adapted to measure the number of rotations of the drive shaft of cable drive motor 102, capstan 106 (FIG. 8) or idler wheels 108 or 110 (FIG. 7). These sensors can comprise any device such as a microswitch used to measure revolutions of the wheel or shaft common in the art.

These sensors can also include devices for detecting markers or indicators attached to the surface of roadway 12.

The information from motion sensors detectors 424 (424*a*, 424*b*, 424*c*) is electrically transmitted to barrier control module 420 for storage and comparison with data already contained in barrier control module 420.

Barrier control module 420 comprises a computer and separate controls (not shown) for each individual drive motor. The computer and controls are well known in the art which includes a memory to store data, a processor to compare data and actuating relays connected thereto and actuated thereby.

To operate the barrier in which the drive motors are contained within the barrier sections, barrier control module 420 is provided with a start control 430 and a stop control 432.

To start the operation, the operator operates phase reversal switch 410 moving it to the "move right" position.

Reversing switch 410 is a three-position switch the central position being the "off" position, the upper position being a "move left" position and the lower position being a "move right" position.

The operator then actuates start switch 430 to begin the first step of the process. The operator, when selecting the "move right" position, thus connects the three motor starter actuating relays 306*a*, 406*b* and 406*c* to power supply 408.

When start switch 430 is activated, relays 402 (402*a*, 402*b*, 402*c*) are also actuated causing motor starter relays 406 (406*a*, 406*b*, 406*c*, 406*d*, 406*e*, 406*f*) to be connected to power supply 408 thus energized, cable drive motors 102*a*, 102*b*, 102*c*, 102*d*, 102*e* and 102*f* now drive capstan 106 (FIGS. 7 and 8) in one direction of rotation.

When drive motors 102*a*, 102*b*, 102*c*, 102*d*, 102*e* and 102*f* are activated, capstan 106 (FIGS. 7 and 8) will be caused to rotate whereby cable 78 (78*a*, 78*b*, 78*c*), frictionally engaging capstan 106, will be pulled to the left causing trolley 100 to move to the right.

As trolley 100 moves to the right, lever arm 66 will also be cause to move to the right in a counterclockwise direction whereby the barrier lifting mechanism, as previously describe for FIGS. 2, 3, 4, 5 and 6, will lift the barrier onto support wheels 38 and 40.

As trolley 100 continues its travel to the right, it will, as previously described for trolley 70, engage bumper plate 90 attached to bases support 24, applying a lateral force thereto causing barrier section 20 to be moved to the right.

As barrier section 20 moves to the right, motion sensor detectors 424 (424*a*, 424*b*, 424*c*) will be sending data to barrier control module 420 where it is compared with data establishing the width of the lanes stored barrier control module 420.

When the data from barrier motion sensors 424 (424*a*, 424*b*, 424*c*) match the data contained in barrier control module 420, barrier control module 420 then sends a signal to deactivate relays 402 (402*a*, 402*b*, 402*c*) to deenergize drive motors 102*a*, 102*b*, 102*c*, 102*d*, 102*e* and 102*f*.

The operator then switches reversing switch 410 to the "move left" position and actuates stop switch 434 again activating drive motors 102*a*, 102*b*, 102*c*, 102*d*, 102*e* and 102*f*. With the polarity of the input power now reversed, capstan 106 is caused to rotate in the reverse direction resulting in a rightward pull on cable 78 (78*a*, 78*b*, 78*c*) moving trolley 100 to the left.

Upon reaching the neutral or central position for lever arm 66 as measured by data received from barrier motion detectors 424 (424*a*, 424*b*, 424*c*), barrier control module 420 deactivates relays 402 (402*a*, 402*b*, 402*c*) thereby leaving the barrier again resting on the surface or roadway 12.

BARRIER CONNECTOR SYSTEM

Figure 14:
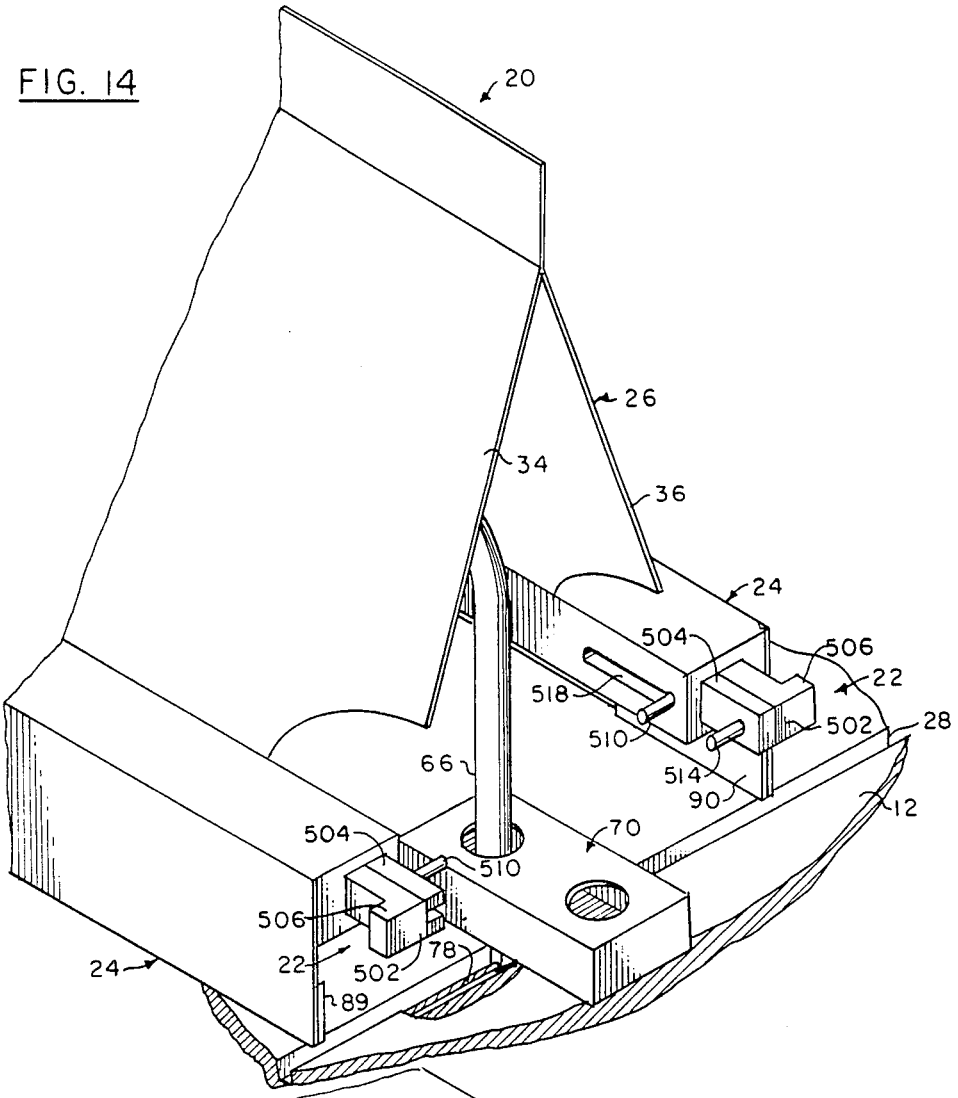
FIG. 14 is an isometric view of one end of the barrier showing the method of connecting the barrier sections to each other and the method of connecting the trolley to lever arm.
Figure 15:
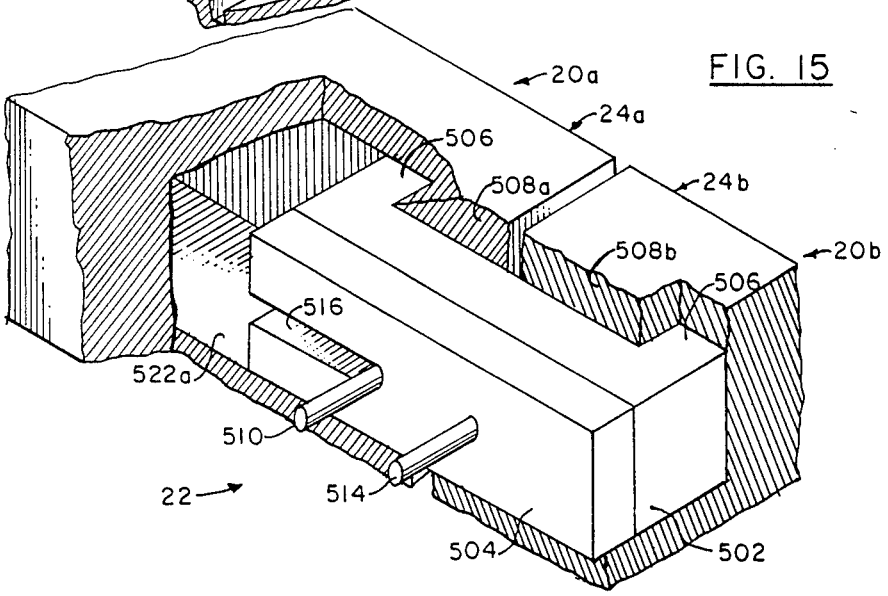
FIG. 15 is an enlarged detail isometric view of the method of connecting the barrier sections to each other.

FIG. 14 is an isometric view of one end of a typical barrier section 20 showing the exposed end of barrier interconnect lock or end connector 22.

Interconnect lock or end connector 22 comprises, basically, a connector block 502 and locking member 504.

Connector block 502 also comprises a pair of end lips 506 which are adapted to engage base support end retainer lips 508*a* and 508*b* corresponding to base supports 24*a* and 24*b*.

Figure 16A:
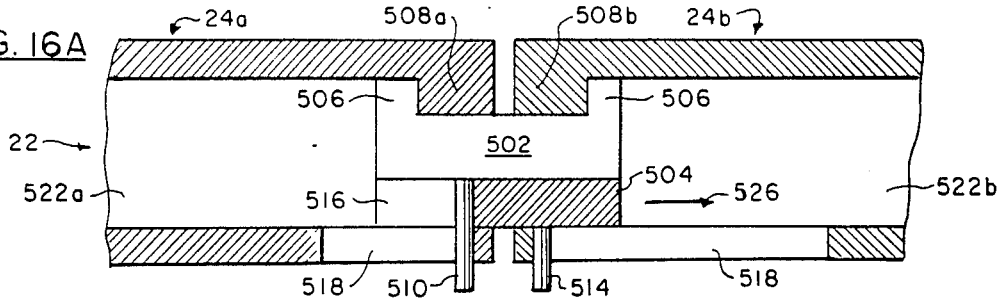
FIGS. 16A, 16B, 16C and 16D are diagrammatic plan views illustrating the method of connecting and disconnecting the end of the barrier sections in which the various parts of the apparatus are shown in various positions to demonstrate the steps involved in disconnecting or connecting the barrier sections together.

Connector block 502 also comprises a connector block handle 510 attached to its back and used moving connector block as shown in FIGS. 16A though 16D.

Locking member 504 also comprises a locking member handle 514 attached to the back of locking member 504 which is also used to move locking member 504 as shown in FIGS. 16A through 16D.

A connector handle slot 516 is provided in connector locking member 504 to permit handle 510 of connector block 502 to be operated as required.

With reference to FIG. 14, base support 24*a* is also provided with a slot 518 to permit either connector block handle 510 or locking member handle 514 to project to the inside of barrier section 20*a* or 20*b* for access by an operator.

To operate the barrier interconnect lock or end connector 22 of the present invention reference is made to FIGS. 16A through 16D.

With reference to FIG. 15A there is illustrated interconnect locking device 500 in the locked position whereby connector block 502 engages base support lips 508*a* and 508*b* between connector block lips 506.

Locking member 504 is shown engaging the back of connector block 502 within channel 522*a* and 522*b* side members of base support 24*a* and 24*b*, respectively.

Figure 16B:
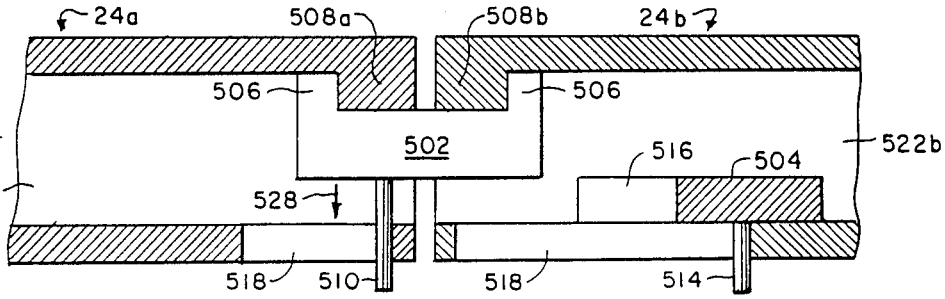

To disconnect the barrier sections, reference is made to FIGS. 16A and 16B where the first step comprises moving locking member 504 to the right, as indicated by arrow 526, using locking member handle 514.

Figure 16C:
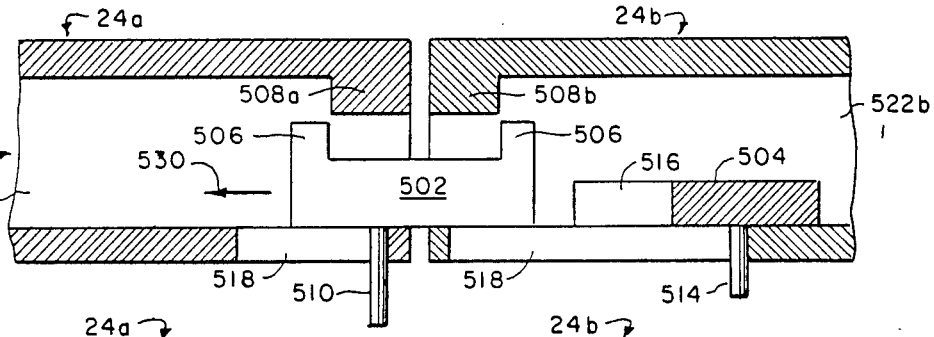
Figure 16D:
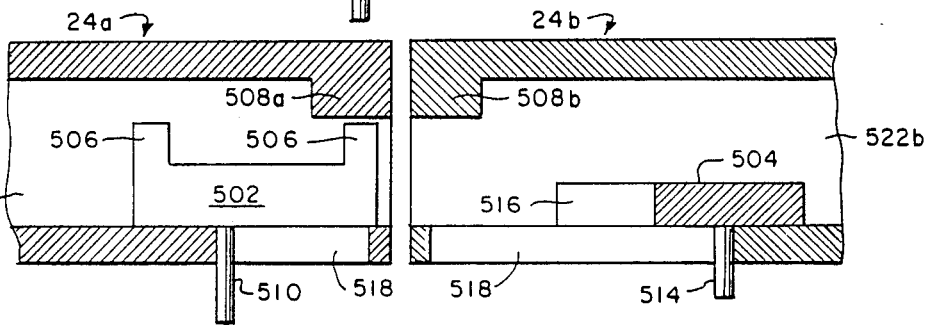

Connector block 502 is then pulled inwardly away from lips 508*a* and 508*b*, as indicated by arrow 528, as shown in FIG. 16C, so that lips 506 of block 502 clear lips 508*a* and 508*b*.

Connector block 502 is then moved to the left using handle 510, as indicated by arrow 530, as shown in FIG. 15*d*, thus completely disconnecting the two barriers from each other.

The same procedure can be followed for disconnecting the other end of one of the barrier sections.

The disconnected barrier can now be lifted out and replaced by a new barrier.

To lock the new barrier to the existing barrier, the steps as described above are reversed so that connector block 502 is moved into place where lips 506 engage lips 508*a* and 508*b* and locking member is moved into a position engaging the back of connector block 502 a shown in FIG. 16A.

Thus is described a movable barrier for a roadway.

I claim:

1. A movable barrier comprising a base support adapted to engage a supporting surface, a generally upright wall member attached to said base support, means for raising and lowering said barrier comprising a set of barrier support wheels, a lever arm, means connected between one end of said lever arm and said set of barrier support wheels for moving said wheels in an upward and downward direction relative to said base support upon actuation of said lever arm, means for moving said barrier in a lateral direction comprising means for moving said lever arm in one direction to lower said wheels and raise said base support above the supporting surface to support said barrier on said support wheels and simultaneously applying a lateral force to said barrier sufficient to move said barrier in a lateral direction on said wheels, and means for moving said lever arm in a reverse direction to raise said wheels and lower said base support to engage the supporting surface.

2. The movable barrier as claimed in claim 1 wherein said means connected between one end of said lever arm and said set of barrier support wheels for moving said wheels in an upward and downward direction relative to said base support upon actuation of said lever arm comprises a cam follower plate, means for connecting said cam follower plate to said support wheels, a cam adapted to engage said cam follower plate, a cam shaft connected to said cam and attached to one end of said lever arm, a cam shaft bearing journalled to said cam shaft and attached to said barrier, said cam shaped to lower said wheels when said lever arm is moved in a direction away from a vertical position, a cam adapted to engage said cam follower plate,

3. The movable barrier as claimed in claim 1 wherein said means connected between one end of said lever arm and said set of barrier support wheels for moving said wheels in an upward and downward direction relative to said base support upon actuation of said lever arm comprises a cam follower plate, means for connecting said cam follower plate to said support wheels, a cam adapted to engage said cam follower plate, a cam shaft connected to said cam and attached to one end of said lever arm, a cam shaft bearing journalled to said cam shaft and attached to said barrier, said cam shaped to lower said wheels when said lever arm is moved in a direction away from a vertical position, and said means for moving said lever arm in one direction to lower said wheels and raise said base support above the supporting surface to support said barrier on said support wheels and simultaneously applying a lateral force to said barrier sufficient to move said barrier in a lateral direction on said wheels comprises a lever arm actuating trolley adapted to engage the end of said lever arm distal said lever arm shaft, a barrier actuating cable attached to said actuating trolley, a first actuating cable drive motor located proximate one side of said barrier and spaced apart therefrom and connected to one end of said actuating cable, a second actuating cable drive motor located proximate the other side of said barrier and spaced apart therefrom and connected to the other end of said actuating cable, means for controlling said first and second actuating cable drive motors comprising means for actuating said first drive motor to apply a force on said cable to pull said actuating trolley in a direction lateral to said barrier and engage a side of said barrier and rotate said lever arm to lift said barrier on said support wheels and pull said barrier in a lateral direction, and means for actuating said second drive motor to pull said actuating trolley in the opposite direction and move said lever arm to a vertical position to lower said base support to engage said supporting surface.

4. A movable barrier comprising a base support adapted to engage a supporting surface, a generally upright wall member attached to said base support, means for raising and lowering said barrier comprising a set of barrier support wheels, a lever arm, means connected between one end of said lever arm and said set of barrier support wheels for moving said wheels in an upward and downward direction relative to said base support upon actuation of said lever arm, means for moving said barrier in a lateral direction comprising means for moving said lever arm in one direction to lower said wheels and raise said base support above the supporting surface to support said barrier on said support wheels and simultaneously applying a lateral force to said barrier sufficient to move said barrier in a lateral direction on said wheels, and means for detecting the distance the barrier has traveled, means for stopping said barrier movement when said means for detecting the distance the barrier has travelled, has detected a predetermined amount of travel, and means for moving said lever arm in a reverse direction to raise said wheels and lower said base support to engage the supporting surface.

5. A movable barrier comprising at least two barrier sections, each comprising a base support adapted to engage a supporting surface, a generally upright wall member attached to said base support, means for raising and lowering said barrier comprising a set of barrier support wheels, a lever arm, means connected between one end of said lever arm and said set of barrier support wheels for moving said wheels in an upward and downward direction relative to said base support upon actuation of said lever arm, means for moving said barrier section in a lateral direction comprising means for moving said lever arm in one direction to lower said wheels and raise said base support above the supporting surface to support said barrier on said support wheels and simultaneously applying a lateral force to said barrier sufficient to move said barrier in a lateral direction on said wheels, and said means for moving said lever arm to one direction to lower said wheels and raise said base support comprising at least one drive motor adapted to move said lever arm bilaterally, means for detecting the distance the barrier has traveled, means for stopping said barrier when said means for detecting the distance the barrier has travelled has detected a predetermined amount of travel, means for moving said lever arm in a reverse direction to raise said wheels and lower said base support to engage the supporting surface.

6. A movable barrier comprising at least two barrier sections, each comprising a base support adapted to engage a supporting surface, a generally upright wall member attached to said base support, seans for raising and lowering said barrier comprising a set of barrier support wheels, a lever arm, means connected between one end of said lever arm and said set of barrier support wheels for moving said wheels in an upward and downward direction relative to said base support upon actuation of said lever arm, means for moving said barrier section in a lateral direction comprising means for moving said lever arm in one direction to lower said wheels and raise said base support above the supporting surface to support said barrier on said support wheels and simultaneously applying a lateral force to said barrier sufficient to move said barrier in a lateral direction on said wheels, said means comprising at least one drive motor adapted to move said lever arm bilaterally, means for detecting the distance barrier has traveled, means for stopping said barrier movement when said means for detecting the distance the barrier has travelled has detected a predetermined amount of travel, said means comprising a computer programmed to control each individual barrier section comprising means for storing predetermine information concerning barrier position, means for receiving signals from said sensors, means for actuating said drive motors based on signals from said sensors and said stored information, and means for actuating said drive motor to move said lever arm in a reverse direction to raise said wheels and lower said base support to engage the supporting surface.

* * * * *